US005788617A

United States Patent [19]

Paris

[11] Patent Number: 5,788,617

[45] Date of Patent: Aug. 4, 1998

[54] PECTORALIS MAJOR AND UPPER BACK EXERCISER

[75] Inventor: Win Paris, Seal Beach, Calif.

[73] Assignee: Fitness Medicine, Seal Beach, Calif.

[21] Appl. No.: 934,206

[22] Filed: Sep. 19, 1997

Related U.S. Application Data

[60] Provisional application No. 60/029,216, Oct. 29, 1996.

[51] Int. Cl.[6] ..... A63B 21/008

[52] U.S. Cl. ..... 482/112; 482/44

[58] Field of Search ..... 482/44, 111, 112, 482/128

[56] References Cited

U.S. PATENT DOCUMENTS

| | | | |
|---|---|---|---|
| 4,832,335 | 5/1989 | Tong | 482/112 |
| 4,869,491 | 9/1989 | Nolan | 482/128 |
| 5,411,460 | 5/1995 | Karlson et al. | 482/112 |

*Primary Examiner*—Lynne A. Reichard
*Attorney, Agent, or Firm*—Morgan & Finnegan LLP

[57] ABSTRACT

An exercise device includes two hand-held grips that generate a pneumatic force that opposes reciprocating movement. Each hand-grip has a piston that moves within and relative to a cylinder. An air outlet associated with each cylinder can be adjusted to adjust the pneumatic force generated by reciprocation. The higher the pneumatic force, the more work is performed to reciprocate the hand-grips.

17 Claims, 5 Drawing Sheets

PECTORALIS MAJOR AND UPPER BACK EXERCISER

A provisional application for the present invention by the same title was filed on Oct. 29, 1996 and assigned Ser. No. 60/029,216, for which priority is hereby claimed.

FIELD OF THE INVENTION

The present invention relates generally to the field of resistance exercise methods and devices and, more specifically, to a hand held, compact exerciser for the pectoralis major, upper back muscles, inner and outer thighs, deltoids, biceps and triceps. A pneumatic, two-way resistance force is generated by the user by action of the hand sliding over the bar. The resistance force can be adjusted according to accommodate users of different strength and fitness.

BACKGROUND OF THE INVENTION

Exercise devices of varying type, form and shape have been known for many years. Perhaps the most widely used device for exercising the upper back and pectoralis major muscle groups is of the type shown in FIG. 1. A pair of handles 10 and 12 are connected by a plurality of springs 14, 16, and 18. As the user pulls the handles apart, by pulling the handles along the axis 20 in opposite directions, the pulling force is resisted by the springs. The tension thereby imparted to the springs generates a restoring force which brings the handles 10 and 12 back together when the pulling force is removed. The resistance of the springs 14, 16 and 18 can be adjusted by adding to or subtracting from the number of springs connected between the handles 10 and 12.

Various mechanisms have been envisioned o generate a resistance force for exercise. For example, U.S. Pat. No. 5,634,874 describes a portable exercise device for the upper anatomy. A slide assembly has two curved slides and a rack formed on each slide. A spring biased elastic resistance member has a pinion interposed between the slides. A brake is used in combination with a clutch to provide one-way resistance.

U.S. Pat. No. 5,437,589 to Habing discloses an exercise device which has a frame, seat and a pair of articulated exercise arm assemblies. The arms are connected to the frame by linkages that permit exercise of different muscles at different positions of movement.

U.S. Pat. No. 4,580,778 to Van Noord describes a portable exercising apparatus which includes an elongated tube and a power slide mounted on the tube. A rack and pinion assembly are used to actuate a force-measuring gauge, and a resilient biasing means can include a compression spring mounted within the tube to exert increasing resistance to relative movement of the tube and the power slide. Two-way resistance can be provided by using two separate springs which compress in response to opposite axially-directed forces.

U.S. Pat. No. 4,019,734 to Lee et al. discloses a hand-held, portable exercise device. The device is made of a single piece of elastic material with handle loops at opposite ends. Surgical tubing is used as an elastic restoring force that resists movement imparted by the user.

While the prior art is replete with a variety of exercise devices which focus on the pectoralis major and upper back muscle groups, there is a continuing need for improved portable devices.

SUMMARY OF THE INVENTION

An object of the present invention is to provide an exercise device which is relatively simple in construction and cost effective to produce.

Another object of the invention is to provide an exercise device which is capable of exercising the pectoralis major and upper back muscle groups, inner and outer thighs, deltoids, biceps and triceps, but small and compact enough to be portable.

Still another object of the invention is to provide an exercise device which can be quickly and easily adjusted to accommodate users of varying strength and conditioning.

These and other objects are achieved by providing an exercise device which includes a bar having two portions angled with respect to each other, a pair of sliding members movably mounted on respective sliding members, and means for generating a resistance force in response to movement of the sliding members. Preferably, the means for generating a resistance force includes a piston mounted in a cylinder, whereby the user's movement of the sliding members imparts relative motion between the piston and the cylinder.

Other objects, advantages, and salient features of the invention will become apparent from the following detailed description, which taken in with the annexed drawings, discloses the preferred embodiment of the present invention.

DETAILED DESCRIPTION OF THE PREFERRED EMBODIMENT

Referring to FIGS. 2–7, an exercise device 22 includes first and second reciprocating members 24 and 26 which are positionally fixed at an angle with respect to each other.

Figure 1:
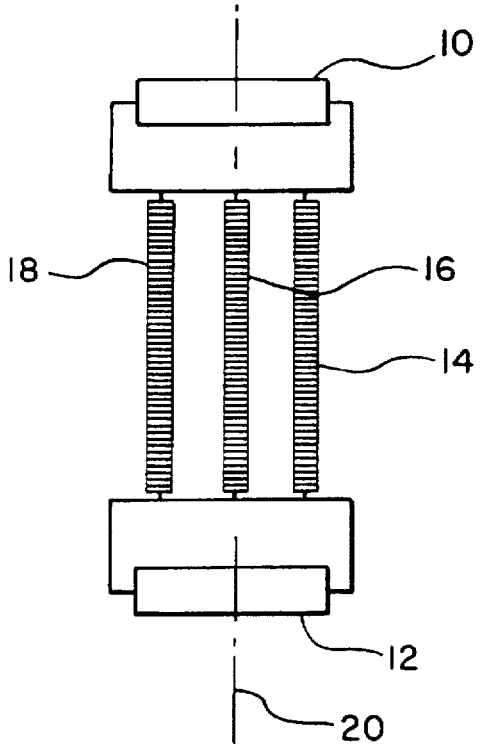
FIG. 1 (PRIOR ART)
FIG. 1 is a plan view of a prior art exercise device which exercises the pectoralis major and upper back muscle groups.
Figure 2:
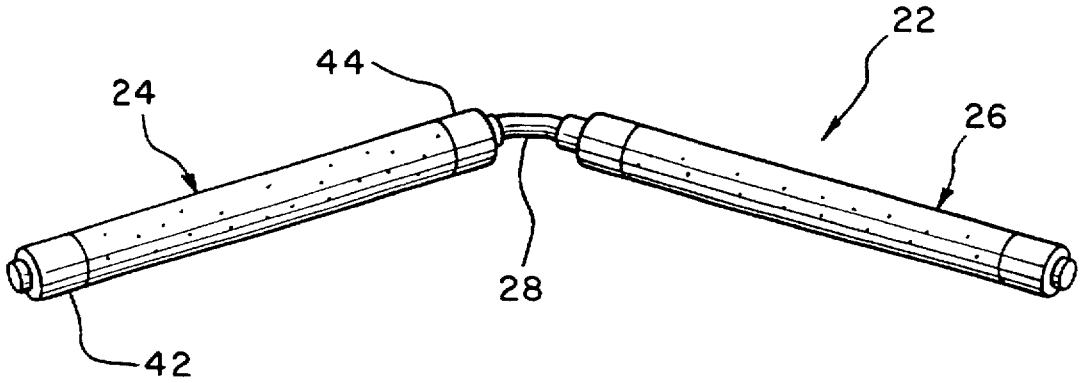
FIG. 2 is a perspective view of an exercise device according to a preferred embodiment of the present invention.
Figure 3:
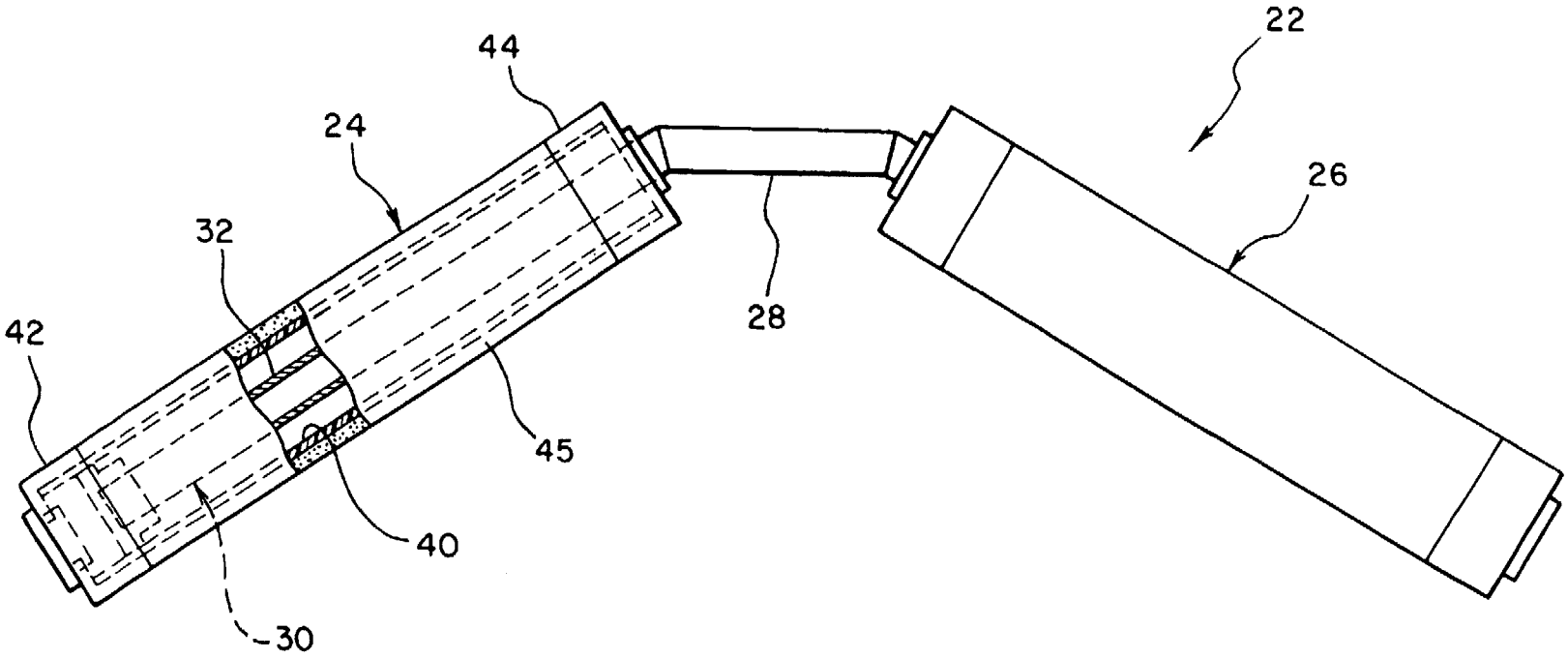
FIG. 3 is an enlarged, plan view, partially in section, of the exercise device of FIG. 2.
Figure 4:
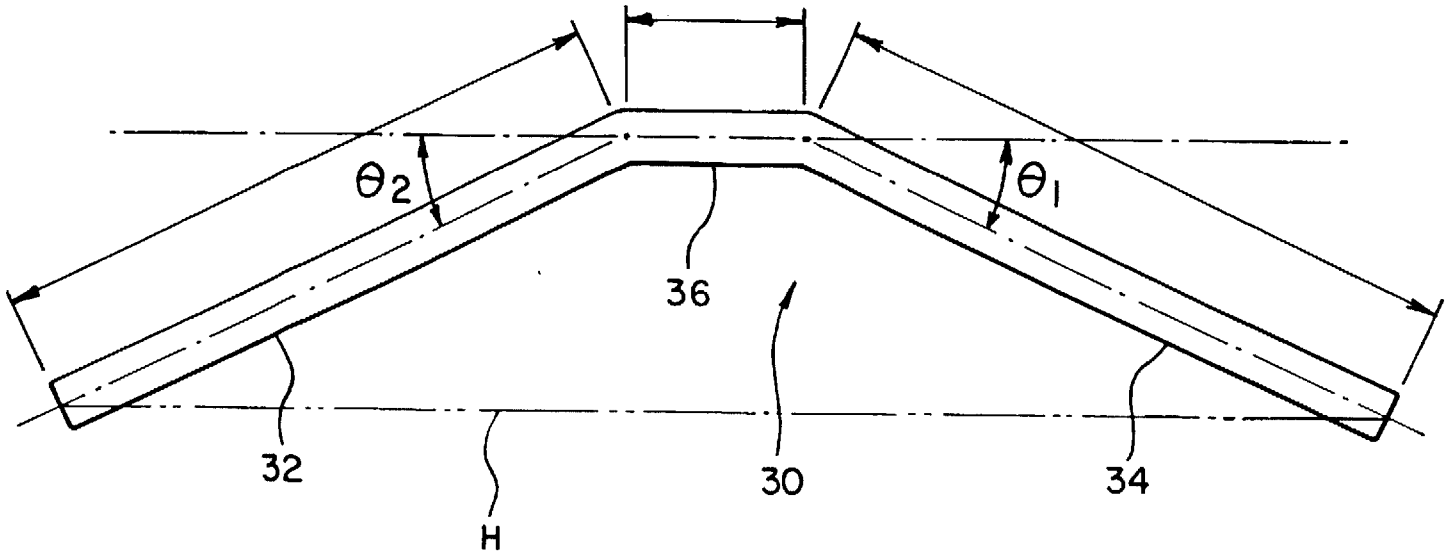
FIG. 4 is a plan view of the support bar used in the exercise device of FIG. 1, and showing relative angles and lengths of the different portions.

Each reciprocating member is preferably angled at a 25° relative to a linking member 28. This feature is best shown in FIG. 4, wherein a support bar 30 includes a first portion 32 and a second portion 34 interconnected to the first portion 32 by a medial portion 36. An angle, $\Theta_1$, between the first portion 32 and an axis through the medial portion 36 is preferably about 25°. This is the same as an angle, $\Theta_2$, between the second portion 34 and the medial portion 36. In general, a hypotenuse, H, extending between the opposite ends of the first and second portions 32 and 34, preferably subtends an obtuse angle.

In a particularly preferred embodiment, the first and second portions 32 and 34 are each 400 mm in length and the medial portion 36 is 150 mm in length, and the support bar 30 is made of a single piece of aluminum pipe, bent to the preferred shaped. The pipe has a diameter of 30 mm.

Figure 5:
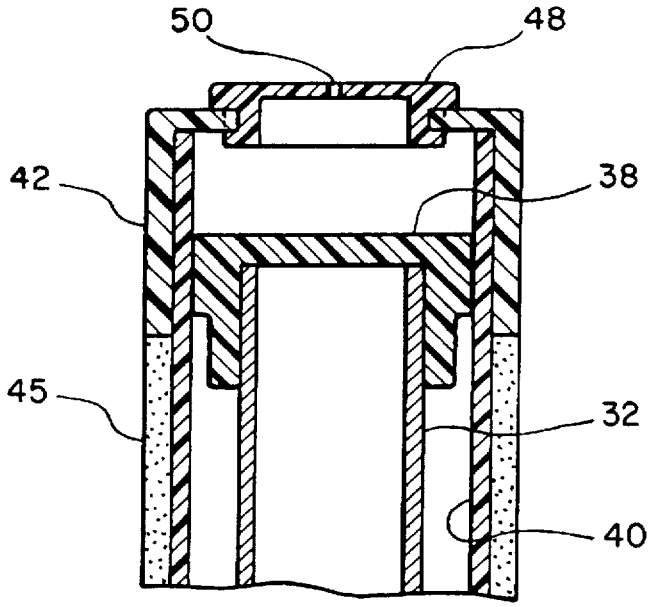
FIG. 5 is an enlarged, cross sectional view of an end portion of the exercise device of FIG. 2.
Figure 6:
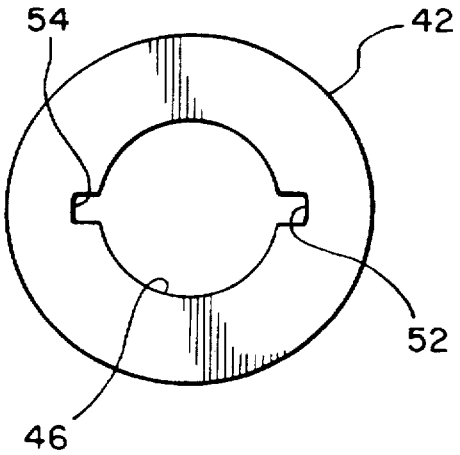
FIG. 6 is a top view of one of the outer cap elements of the exercise device of FIG. 2.
Figure 7:
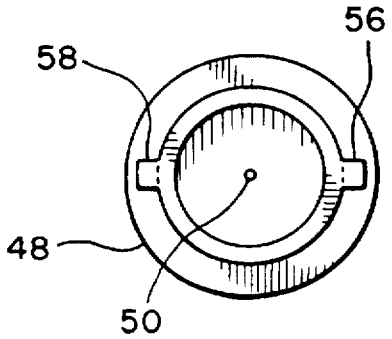
FIG. 7 is a bottom view of one of the adjustment pins used in the exercise device of FIG. 2.

Referring to FIGS. 5–7, the distal end of the first portion 32 of the support bar 30 is fitted with a piston 38. The piston 38 is enclosed in a cylinder which is defined by an outer tube 40 and opposite end caps 42 and 44. The piston 38 is fixedly connected to the end of the first portion 32 using any suitable means, including an interference fit, adhesive bonding, threaded connection (by providing mating threads on the inner diameter of the piston and the outer diameter of the first portion 32, etc.). The same is true for the end caps 42 and 44. Preferably, the outer tube is made of a plastic material, such as polyethylene, and the end caps and pistons are made of a similar, compatible material. The space between the end caps 42 and 44 is preferably fitted with a relatively soft foam sleeve 45. This area is where the user grips the exercise device with one hand; the opposite portion is gripped with the other hand.

An opening is provided in the end cap 42 so that as the cylinder moves relative to the piston, air is either drawn into or pushed out of the cylinder, creating a pneumatic resistance to that relative motion. The pneumatic resistance is what the user works against to improve his or her strength in the pectoralis major and upper back muscle groups.

As shown in FIG. 6, the end cap 42 is provided with an opening 46. To provide means for adjusting the pneumatic resistance of the exercise device, an adjustment pin 48 is received in the opening 46. The adjustment pin 48 has a central opening 50 through which air can be drawn into or pushed out of the cylinder. Increasing the size of the opening 50 will reduce the pneumatic resistance of the device. This can be done in any number of ways. In the illustrated embodiment, slots 52 and 54 are formed on diametrically opposite sides of the perimeter of the opening 46 of the end cap 42. Correspondingly shaped tabs 56 and 58 are formed on diametrically opposite sides of a lower portion of the adjustment pin 48.

To assemble, the pin 48 is aligned with the opening 46 of the end cap 42 so that the neck of the pin 48 can be fitted into the opening 48. Once inserted, the pin 48 is rotated to move the tabs 56 and 58 away from the slots 52 and 54. When the slots and tabs are no longer aligned, the pin 48 is locked into position and no additional air outlets are provided.

To change the pneumatic resistance, the adjustment pin 48 can be exchanged for one or more having a variety of different opening sizes, each size selected to provide a specific resistance force.

Other adjustment means would entail and threaded connection between the pin 48 and the opening 46 of the end cap 42 so that the pneumatic force can be adjusted by advancing or retreating the pin 48 from the opening. In that embodiment, tabs and slots would not be required. The neck portion of the pin could be provided with perforations so that un-screwing the pin to advance it outwardly from the opening would expose an increasing number of perforations to the outside, thus progressively reducing the pneumatic force as the pin 48 advanced outwardly from the opening.

The second reciprocating member 26 has the identical features described above with respect to the first reciprocating member, in that the same end caps, pistons, etc. would be employed to generate a pneumatic force that resists reciprocating movement of the piston relative to the cylinder.

Figure 8:
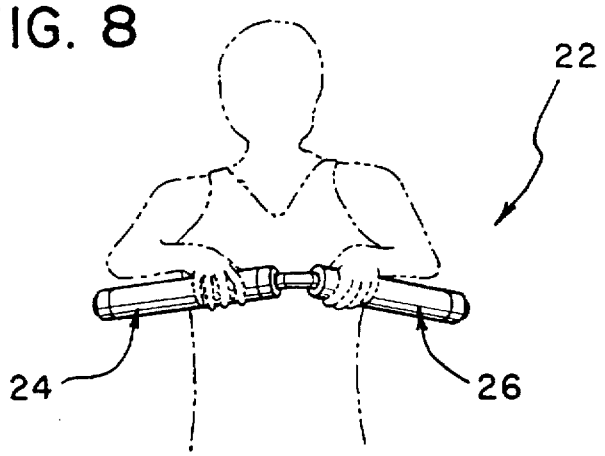
FIG. 8 is a front, perspective view showing the retracted position of the exercise device of FIG. 2.
Figure 9:
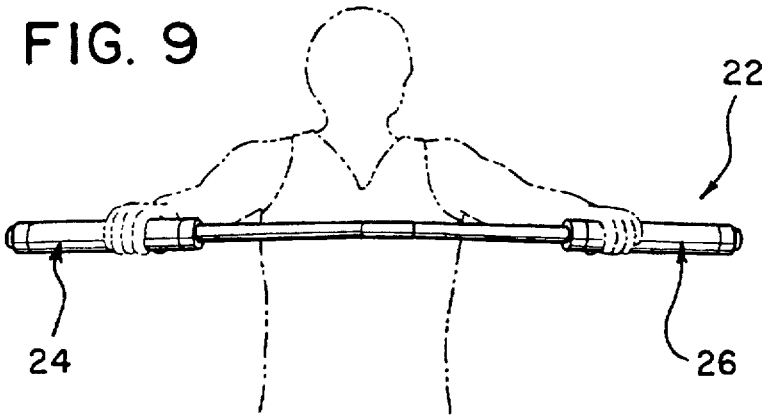
FIG. 9 is a front, perspective view showing the extended position of the exercise device of FIG. 2.

One method of using the exercise device according to the present invention is illustrated in FIGS. 8 and 9. In FIG. 8, the exercise device 22 is shown with the reciprocating members 24 and 26 in a retracted position. The user is shown (in phantom lines) holding the reciprocating members in opposite hands. In FIG. 9, the device 22 is shown with the reciprocating members 24 and 26 in the fully extended position, which is arrived at by having the user move his hands and arms outwardly. The outward motion is resisted by the pneumatic forces generated respectively by the reciprocating members 24 and 26. That force can be adjusted to create a level of force compatible with the individual user. Repetitive motions, with the exercise device held outwardly in front of the user, will exercise the pectoralis major and upper back muscle groups.

Figure 10:
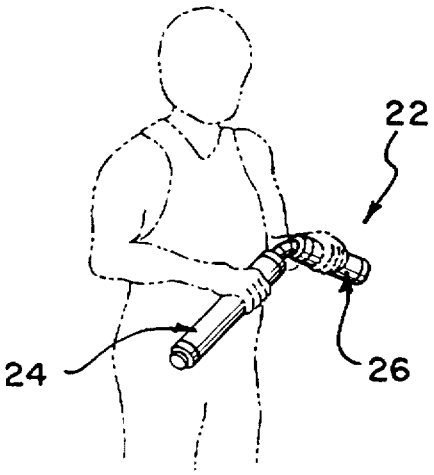
FIG. 10 is a side, perspective view showing the retracted position of the exercise device of FIG. 2, in anticipation of exercise using only one arm.
Figure 11:
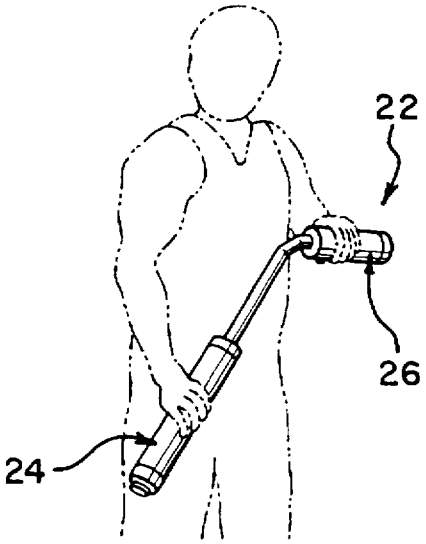
FIG. 11 is a side perspective view showing the extended position of one reciprocating member of the exercise device of FIG. 2.

In FIGS. 10 and 11, the user holds the exercise device close to the body. With the left arm and hand kept relatively stationary, the user pulls downwardly on the reciprocating member 24 to attain the extended position as illustrated. In repetitive fashion, the user then pushes upwardly to re-attain the retracted position. This motion will provide additional work to the biceps and triceps muscles of the arm. Each arm can be done alternatingly as needed.

The reciprocating members provide two-way resistance so that work is performed in moving the hand-grips in either direction. Moreover, different muscle groups can be exercised by holding the exercise device in different positions relative to the body. The reciprocating members can be moved one at a time, as shown in the method of FIGS. 10 and 11, or simultaneously as shown in the method of FIGS. 8 and 9.

In alternative embodiments of the invention, the angle of the two hand portions of the bar could be variable, not fixed, between a range. Also, and in particular when a variable angle is desired, the bar could be made to fold in half for easy storage and portability. Any suitable joint could be used to facilitate the variable angle feature and/or the foldable feature.

While the preferred embodiment of the present invention has been shown and described, it will be understood that it is intended to cover all modifications and alternate methods falling within the spirit and scope of the invention as defined in the appended claims or their equivalents.

What is claimed is:

1. An exercise device comprising:

first and second hand-held reciprocating members interconnected to each other through a linking member disposed therebetween; and two-way resistive force generating means for generating a force that opposes reciprocating movement of the first and second reciprocating members, in response to the reciprocating movement of the first and second hand-held reciprocating members.

2. An exercise device according to claim 1, wherein a hypotenuse extending between opposite ends of the first and second reciprocating members subtends an obtuse angle.

3. An exercise device according to claim 1, wherein the linking member includes means for adjusting the angle of the reciprocating members relative to the linking member.

4. An exercise device according to claim 1, further comprising means for adjusting a magnitude of the force opposing reciprocating motion.

5. An exercise device according to claim 1, wherein the force opposing reciprocating motion is a pneumatic force.

6. An exercise device according to claim 1, wherein each reciprocating member includes a piston disposed in a cylinder.

7. An exercise device according to claim 6, wherein each cylinder includes an air outlet and means for adjusting the size of the air outlet to thereby adjust a pneumatic force generated by relative motion between the cylinder and the piston.

8. An exercise device for exercising the pectoralis major and upper back muscle groups comprising:

a support bar having a left-hand portion and a right-hand portion;

a linking member disposed between the left-hand portion and the right-hand portion of the support bar;

a left-hand grip slidably mounted on the left-hand portion of the support bar;

a right-hand grip slidably mounted on the right-hand portion of the support bar;

a piston mounted on each of the distal ends of the left-hand and right-hand portions of the support bar, wherein reciprocating movement of the left-hand grip and the right-hand grip generates a pneumatic force that opposes reciprocating motion; and means for adjusting the pneumatic force.

9. An exercise device according to claim 8, wherein a hypotenuse extending between the distal ends of the left-hand and right-hand portions of the support bar subtends an obtuse angle.

10. An exercise device according to claim 8, wherein each of the left-hand grip and the right-hand grip includes a cylinder having opposite end caps and an outer sleeve.

11. An exercise device according to claim 10, wherein the outer sleeve is made of a foam material.

12. An exercise device according to claim 10, wherein the means for adjusting the pneumatic force includes an adjustment pin disposed in one of the end caps of each cylinder.

13. A method of exercising the pectoralis major and upper back muscle groups, comprising the steps of:

holding in opposite hands first and second reciprocating members that are interconnected to each other through a linking member disposed therebetween, each reciprocating member having two-way resistive force generating means for generating a force that opposes reciprocating movement of the first and second reciprocating members, in response to the reciprocating movement of the first and second hand-held reciprocating members; and moving the hands relative to each other to thereby reciprocate at least one of the first and second reciprocating members.

14. A method according to claim 13, further comprising moving both hands simultaneously.

15. A method according to claim 13, further comprising moving one hand while holding the other stationary.

16. A method according to claim 13, further comprising adjusting a magnitude of the pneumatic force.

17. A method according to claim 13, further comprising adjusting the angle between the first and second reciprocating members.

* * * * *

UNITED STATES PATENT AND TRADEMARK OFFICE

CERTIFICATE OF CORRRECTION

PATENT NO. : 5,788,617
DATED : August 4, 1998
INVENTOR(S) : Win Paris It is certified that error appears in the above-identified patent and that said Letters Patent is hereby corrected as shown below:

On the title page, under item [56], insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 3 | 4 | 7 | 1 | 1 | 4 | 5 | 10/07/69 | Berger | | | |
| | | 5 | 0 | 4 | 4 | 6 | 3 | 0 | 09/03/91 | Ventimiglia | | | |
| | | 5 | 3 | 7 | 2 | 5 | 6 | 4 | 12/13/94 | Spirito | | | |
| | | | | | | | | | | | | | |

Signed and Sealed this

Second Day of March, 1999

*Attest:*

*Attesting Officer*

Q. TODD DICKINSON

*Acting Commissioner of Patents and Trademarks*